US006474854B2

(12) United States Patent
Ohshio

(10) Patent No.: US 6,474,854 B2
(45) Date of Patent: Nov. 5, 2002

(54) VEHICULAR HEADLAMP

(75) Inventor: Hirohiko Ohshio, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 62 days.

(21) Appl. No.: 09/772,299

(22) Filed: Jan. 29, 2001

(65) Prior Publication Data

US 2001/0028566 A1 Oct. 11, 2001

(30) Foreign Application Priority Data

Jan. 31, 2000 (JP) ..... 2000-023051

(51) Int. Cl.[7] ..... B60Q 1/04
(52) U.S. Cl. ..... 362/512; 362/539; 362/319
(58) Field of Search ..... 362/280, 281, 362/282, 284, 319, 322, 324, 351, 512, 513, 539

(56) References Cited

U.S. PATENT DOCUMENTS 4,951,178 A * 8/1990 Shirai et al. ..... 362/319
5,213,406 A 5/1993 Neumann et al. ..... 362/61
6,190,029 B1 * 2/2001 Taniuchi et al. ..... 362/539

FOREIGN PATENT DOCUMENTS

GB 2332742 A 6/1999 ..... B60Q/1/076
GB 2345747 A 7/2000 ..... B60Q/1/14

* cited by examiner

*Primary Examiner*—Y. My Quach-Lee
(74) *Attorney, Agent, or Firm*—Fish & Richardson, P.C.

(57) ABSTRACT

A shade driving unit is provided below a discharge bulb, and a fixed shade for covering a movable shade is provided close to the front side of the movable shade to conceal substantially the shade moving mechanism of the shade driving unit. Moreover, the shade leg portion of the fixed shade is fitted to a fixed shade-leg fitting projection formed below a reflector from its rear side to conceal substantially the mounting structure. Further, a pair of lateral upright walls extending from the fixed shade-leg fitting projection is formed below the reflector. The shade moving mechanism can thus be substantially concealed from either side of the fixed shade, even from a laterally shifted viewpoint from the front of the lamp.

9 Claims, 6 Drawing Sheets

VEHICULAR HEADLAMP

BACKGROUND OF THE INVENTION

The present invention relates to a vehicular headlamp capable of varying its light distribution.

Vehicular headlamps reflect light from light sources forwardly to emit low or high beams. Two light sources or two light source bulbs are commonly used to switch between low and high beams.

However, a single light source may be used in switching beams and this is particularly the case with a two-lamp headlamp, which uses a single discharge bulb.

A movable shade that blocks light from a single light source can be used to switch between low and high beams. The shade is moved between two positions by a shade driving unit, blocking the light from the light source in different degrees.

The shade moving mechanism of the shade driving unit is somewhat concealed by providing the shade driving unit below the light source and by providing a fixed shade close to the front area of the movable shade. The shade moving mechanism is further concealed by fixing a shade fitting leg at a lower portion of a reflector of the headlamp.

However, a substantial portion of the shade moving mechanism is visible from either side of the fixed shade, even from a laterally shifted viewpoint from the front of the lamp.

Further, the fitting leg structure screwed to the reflector from the front side can be visible externally from the lamp. Also, the fixed shade can degrade the external appearance of the lamp.

The above conditions would be generally true whenever a movable shade is used to block the light from the light source.

An object of the present invention is to provide a vehicular headlamp designed to vary the light distribution of the headlamp by moving a shade, and, at the same time, to improve the external appearance of the lamp.

SUMMARY OF THE INVENTION

The present invention relates to a novel reflector that accomplishes the above object.

A vehicular headlamp according to the invention comprises a light source, a reflector for reflecting light from the light source forward, a movable shade, disposed in front of the light source, for shading part of the light incident on the reflector from the light source, and a shade driving unit for moving the movable shade between at least two positions where the degrees of shading are different.

The shade driving unit is provided below the light source. A fixed shade for covering the movable shade is provided close to the front of the movable shade.

A fixed shade-leg fitting projection and a pair of lateral upright wall members extending backward from the projection are formed below the movable shade and below the light source.

The light source should not be limited to any specific kind. It can be a discharge light bulb or more specifically an incandescent bulb such as a halogen bulb.

The movable shade can be of any kind capable of shading part of the light incident on the reflector from the light source bulb. It is not limited to a specific configuration.

The movable shade can assume other positions besides a position for forming either a low or high beam light distribution pattern.

The shade driving unit should be designed to move the shade at least between two positions. The shade driving unit can include a solenoid or a pulse motor. Further, the shade driving unit may pivotally or linearly move the shade. Other motions are also within the scope of the present invention.

As long as the projection is capable of mounting the leg of the fixed shade, it should not be limited to a specific size or configuration. Also, the upright wall member is also not limited to a specific size or configuration as long as it is formed to extend from the projection.

DETAILED DESCRIPTION OF THE INVENTION

The vehicular headlamp according to the invention comprises a shade driving unit for pivoting a movable shade between a low beam position and a high beam position. The movable shade is formed in front of the light source and capable of shading part of light incident on the reflective surface of a reflector from a discharge light emitting portion of a discharge bulb. The shade driving unit is provided below the discharge bulb with a fixed shade for covering the movable shade. The shade moving mechanism of the shade driving unit is substantially concealed from the outside of the headlamp.

A projection for fitting a leg portion of the fixed shade is formed below the movable shade and the light source, together with a pair of lateral upright wall portions extending backward from the projection. The shade driving unit is situated between the wall portions. Thus, a substantial part of the shade moving mechanism of the shade driving unit is concealed from either side of the fixed shade, even from a laterally shifted viewpoint from the front of the lamp.

The vehicular headlamp arranged to vary the light distribution by moving the movable shade according to the invention can improve the appearance of the lamp.

Since both of the upright wall portions are integrally formed with the fixed shade-leg fitting projection according to the invention, the rigid support of the fixed shade as well as that of the reflector itself can be sufficiently increased, although the rectangular opening portion for receiving the shade moving mechanism is formed at the lower portion of the reflector.

Since the shade leg portion of the fixed shade is fitted from the back of the fixed shade-leg fitting projection formed below the movable shade, the screws or their equivalents used in the fitting structure are substantially not visible from the outside of the lamp. Consequently, the external appearance of the lamp is improved.

The upper edge of the upright wall portion is configured to increase gradually in height from front to rear. Thus, the rigid support of the fixed shade and of the movable shade can be increased further. Additionally, a mold for easily molding the movable shade can be adopted. Further, longitudinal pivotal motion of the movable shade will not cause any interferences by the movable shade. Thus, the shade moving mechanism can be substantially concealed from either side of the fixed shade.

An embodiment of the present invention will now be described with reference to the drawings.

Figure 1:
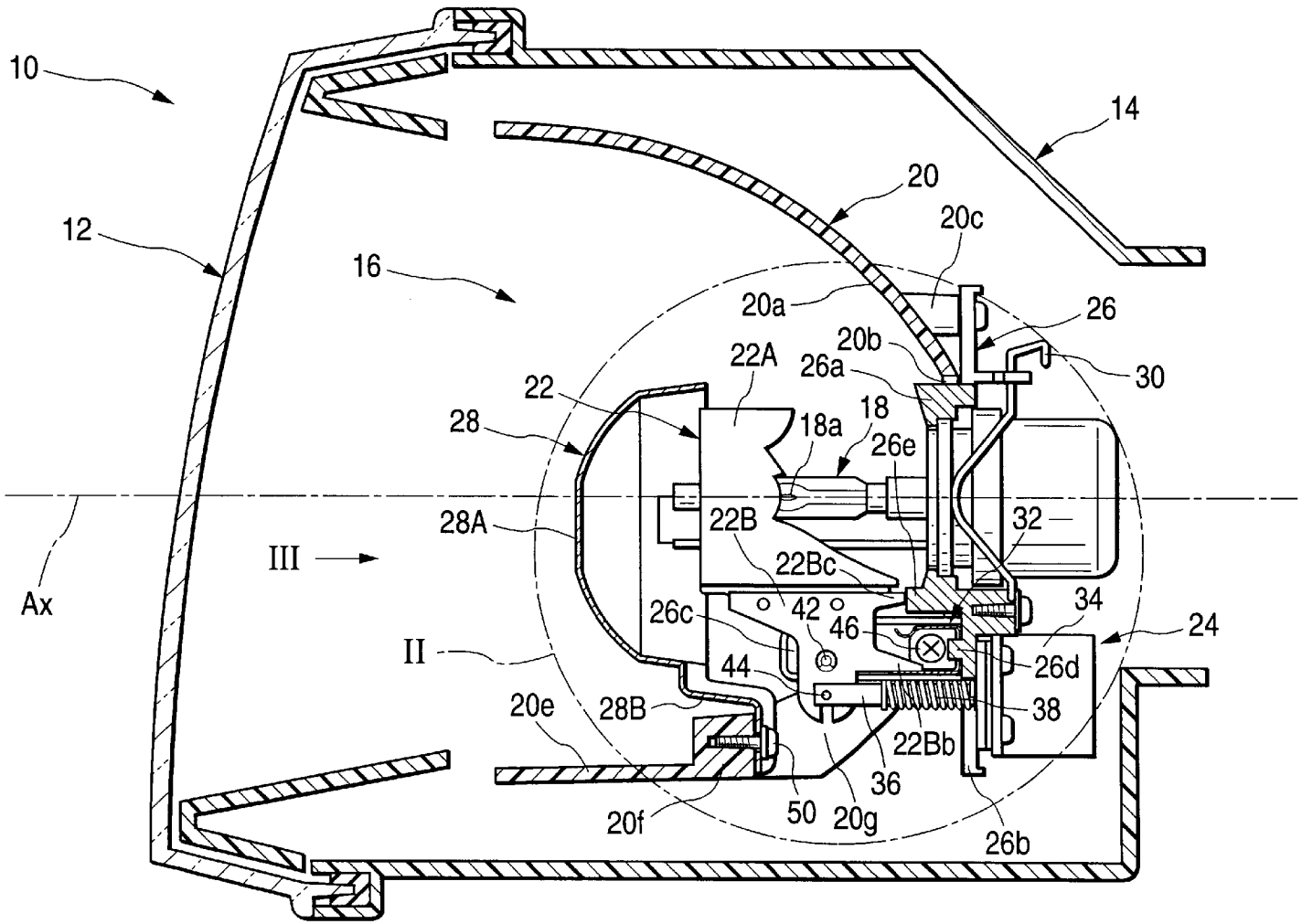
FIG. 1 is a sectional side view of a vehicular headlamp embodying the invention.

According to an embodiment of the invention in FIG. 1, a vehicular headlamp 10 comprises a movable shade unit 16 capable of tilting vertically and horizontally through an aiming mechanism (not shown) within a lamp chamber formed by a transparent cover 12 and a lamp body 14.

The movable shade unit 16 comprises a discharge bulb (metal halide bulb) 18, a movable shade 20, a movable shade 22, a shade driving unit 24, a bulb supporting base 26, and a fixed shade 28.

The transparent cover 12 is made of glass. The movable shade unit 16 functions to control the light distribution. The movable shade 20 has a reflective surface 20*a* for forwardly reflecting light from the discharge light emitting portion (light source) 18*a* of the discharge bulb 18. The reflective surface 20*a* diffuses or deflects the light to form a predetermined light distribution pattern.

The discharge bulb 18 is fixedly supported by the movable shade 20 through a bulb supporting base 26. The bulb supporting base 26 is formed by die casting and is inserted into the rear top opening portion 20*b* of the movable shade 20 from the back. A plurality of bosses 20*c* with screws are used to fix the base 26 on the back side of the movable shade 20. The discharge bulb 18 is fixedly supported with the bulb supporting base 26 by a wire spring 30. The discharge light emitting portion 18*a* of the discharge bulb 18 is positioned on an optical axis Ax of the movable shade 20.

A rectangular opening portion 20*d* communicating with the rear top opening portion 20*b* is formed below the rear top opening portion 20*b* of the reflective surface 20*a*. The shade moving mechanism of the shade driving unit 24 is housed in the rectangular opening portion 20*d*. Further, an undersurface wall 20*e* is formed at the lower end portion of the reflective surface 20*a*, and a fixed shade-leg fitting projection 20*f* projecting upward is formed at the front end portion of the rectangular opening portion 20*d* of the undersurface wall 20*e*. A pair of upright wall portions 20*g* is also formed on the respective lateral sides of the rectangular opening portion 20*d* of the reflective surface 20*a*. The upper front end portion of each upright wall portion 20*g* is positioned to have substantially the same height as that of the fixed shade-leg fitting projection 20*f*. The rear end portion of each upright wall portion 20*g* has substantially the same height as that of the lower end portion of the rear top opening portion 20*b*. The mid-portion of the wall portion 20 is set to increase gradually in height from front to back.

The movable shade 22 comprises a cylindrical shade body 22A whose rear end edge has a complicated rugged shape and a plate-like movable shade leg portion 22B extending downward and slightly rearward from the lower end portion of the shade body 22A. The shade body 22A and the shade leg portion 22B are fixed by rivets.

Figure 2:
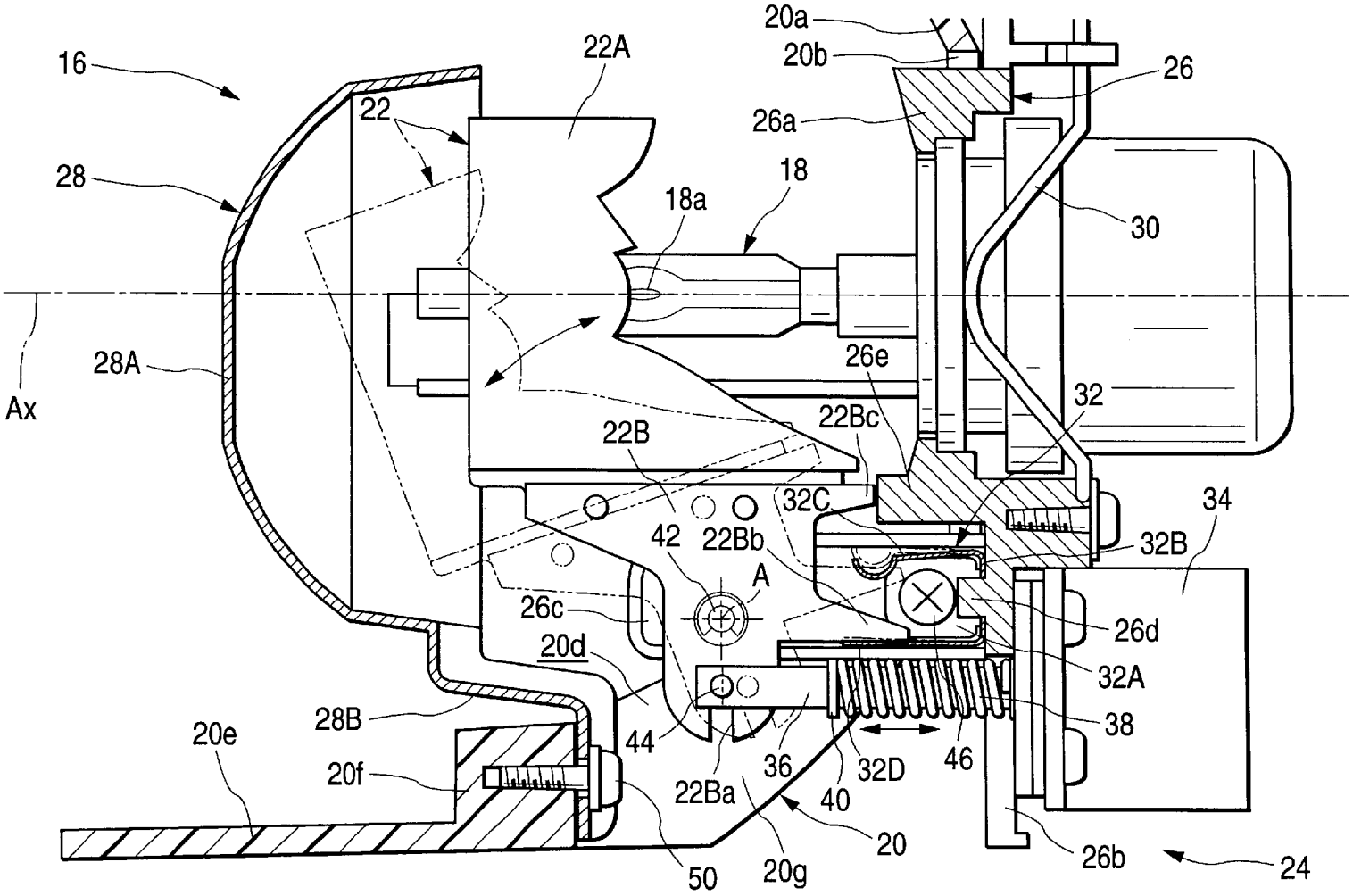
FIG. 2 is a detail view of portion II of FIG. 1.
Figure 3:
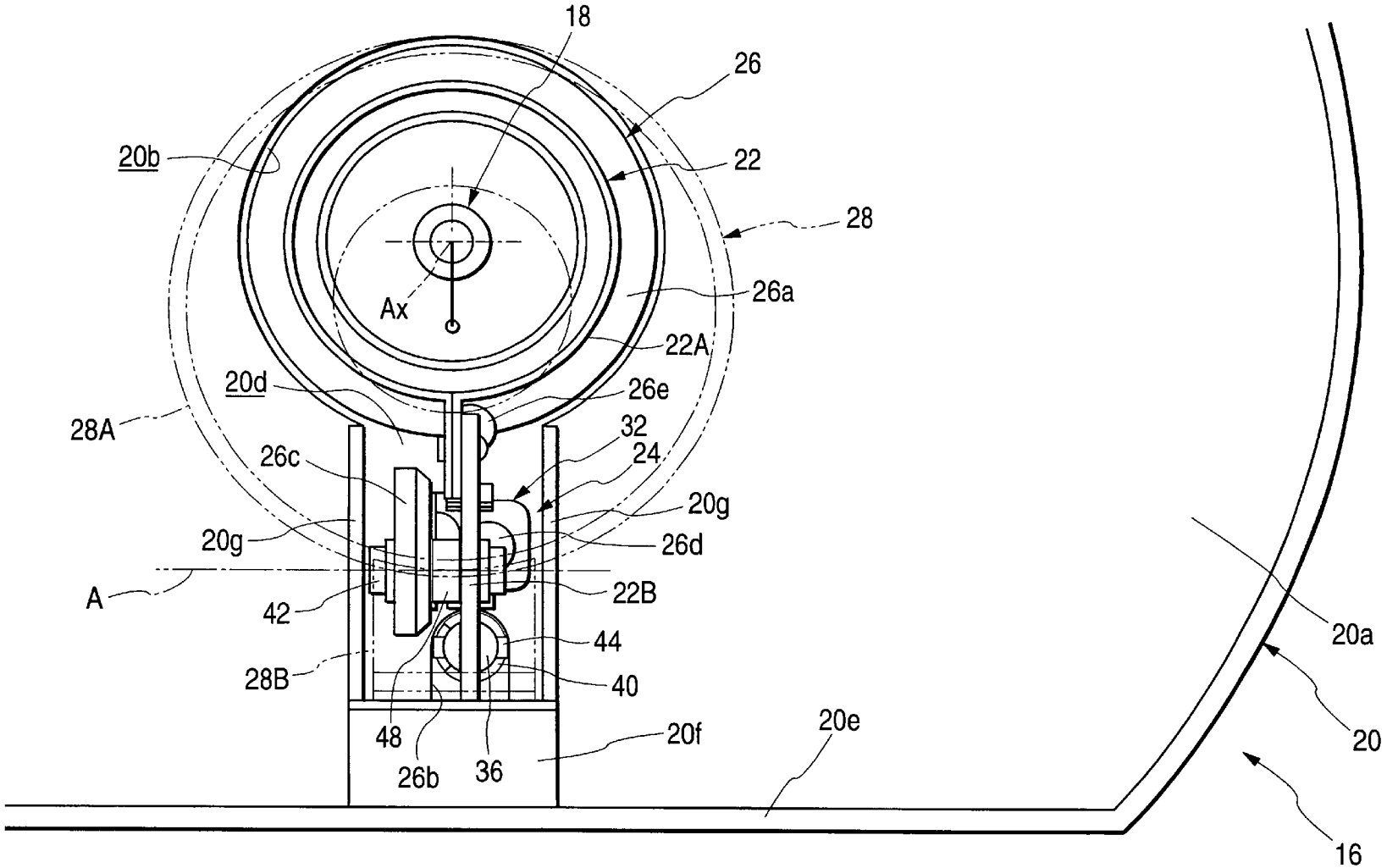
FIG. 3 is a detail view of line III of FIG. 1.
Figure 4:
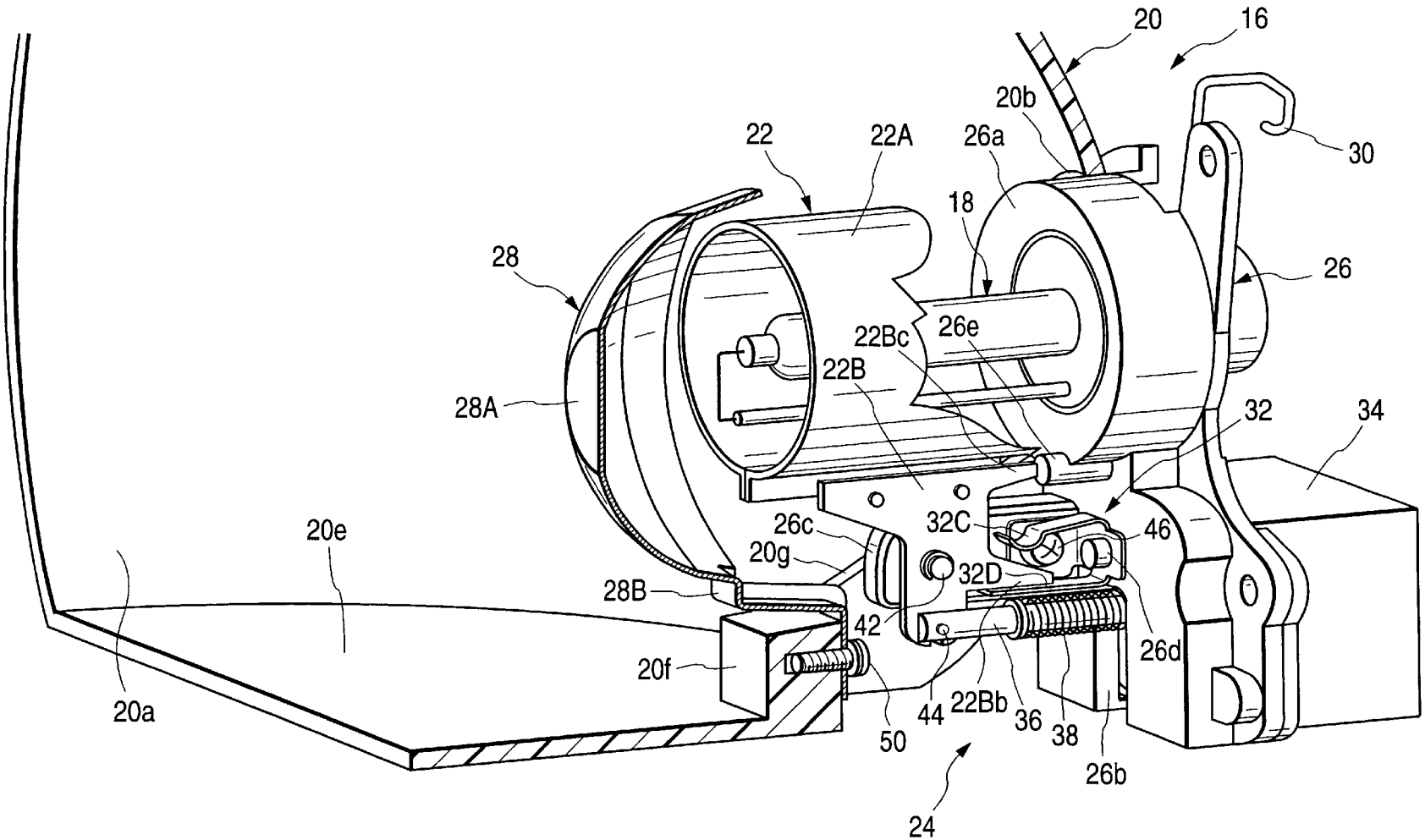
FIG. 4 is a detail perspective view of portion II of FIG. 1.

As seen in FIG. 2, the shade driving unit 24 moves the shade 22 to assume a low beam position as shown by a solid line and a high beam position as shown by a double-dashed line. The movable shade 22 in the low beam position blocks part of light incident on the reflective surface 20*a* of the reflector 20 from the discharge light emitting portion 18*a*. The reflector 22 in the high beam position has reduced blockage of light incident on the reflective surface 20*a* because of the position of the shade body 22A.

The shade driving unit 24 includes a solenoid 34 fixedly screwed to the bulb supporting base 26 under the optical axis Ax of the reflector 20 and a return spring 38 fitted to a movable iron core 36 of the solenoid 34. The spring 38 urges the movable iron core 36 back to a non-excited position.

The movable iron core 36 passes forwardly through an inverted U-shaped groove 26*b* formed at the lower end portion of a bulb supporting base 26. An E-ring 40 at the mid section of the core 36 stops the return spring 38 by abutting against the laterally forked front end of the return spring.

The reflector 22 is pivotally supported around a pivotal axis A laterally extending through a shaft member 42, which is formed to protrude forward from the bulb supporting base 26 in the mid section of the shade leg portion 22B. An annular spacer 48 is installed between the shade leg portion 22B and a support bracket portion 26*c* to tighten the coupling of the shade leg portion 22B and the shaft member 42.

The reflector 22 is coupled to the front end portion of the movable iron core 36 by a pin 44 at the lower end portion of the shade leg portion 22B. The front end portion of the shade leg portion 22B is laterally clamped with the forked front end portion of the movable iron core 36. The reflector 22 is fixed to the front end portion by laterally passing the pin 44 through. A slit 22B*a* for receiving the pin 44 is formed at the front end portion of the shadeleg portion 22B that extends vertically. By having the pin 44 move within the slit 22B*a* as the reflector 22 pivots, variations in distance between the shaft member 42 and the pin 44 are absorbed.

A displacement regulating member 32 is fitted close to the base end portion of the supporting bracket portion 26*c* of the bulb supporting base 26.

The displacement regulating member 32 made by bending a metal plate comprises a screw-tightening seat portion 32A into which each screw is inserted, a positioning seat portion 32B, a pair of vertical positioning seat portions 32B respectively formed with positioning holes, and a pair of vertical elastic pieces 32C and 32D extending forward from the positioning seat portion 32B. The lower elastic piece 32D is forwardly extended in flat-plate form. The flat-plate-like upper elastic piece 32C extends forwardly with its front end portion substantially in semicircular form directed slightly downward.

Each boss 26*d* protruding forward is formed close to the base end portion of the supporting bracket portion 26*c* on the front side of the bulb supporting base 26. Each boss 26*d* is inserted into the positioning hole to bring the positioning seat portion 32B into contact with the front of the bulb supporting base 26. While the positioning seat portion 32B is kept in contact with the side of the supporting bracket portion 26*c*, each screw 46 is tightened to the side of the supporting bracket portion.

To position between the elastic pieces 32C and 32D, a first projection 22B*b* is formed backwardly at the lower rear edge face portion of the shade leg portion 22B. The upper edge face of the first projection 22B*b* extends downward. Its lower edge face in wedge form extends substantially horizontally.

The elastic piece 32D is resiliently brought into contact with the lower edge face of the first projection 22Bb in the low beam position. On the other hand, the elastic piece 32C is resiliently brought into contact with the upper edge face of the first projection 22B*b* in the high-beam position. In this way, the backlash of the shade moving mechanism of the shade driving unit 24, that is, the backlash of the coupling portion between the shade leg portion 22B and the shaft member 42, the backlash of the coupling portion between the shade leg portion 22B and the movable iron core 36 of the solenoid 34 or the backlash of the movable iron core 36 itself, is reduced. Further, any dimensional variations of component members are also accommodated. Thus, the displacement of the reflector 22 from the low-beam position or the high-beam position toward its pivoting direction can be regulated. Also, the sound generated when the elastic piece is brought into contact therewith is minimized.

A second projection 22B*c* is formed backwardly above the rear edge face of the shade leg portion 22B. Further, a stopper pin 26*e* is formed forwardly at the lower end portion of an annular supporting portion 26*a* in front of the bulb supporting base 26. While the reflector 22 is in the low-beam position, the front edge face of the stopper pin 26*e* faces the rear edge face of the second projection 22B*c* with a slight gap. Suppose the reflector 22 over pivots beyond the low-beam position because of, for example, a malfunction of the shade driving unit 24. The pivotal movement is stopped by the second projection 22B*c* contacting the stopper pin 26*e*.

The fixed shade 28 for covering the reflector 22 is provided in front of the reflector 22. The fixed shade 28 is formed integrally with a cap-like shade body 28A. A sectionally U-shaped shade leg portion 28B extends from the lower end portion of the shade body 28A downward and has an intermediate portion that is offset backward. Further, the fixed shade 28 is tightly fixed to the back surface of the fixed shade-leg fitting projection 20*f* of the reflector 20 with a screw 50 in the lower end portion of the shade leg portion 28B. The shade leg portion 28B is substantially similar in breadth to the rectangular opening portion 20*d* of the reflector 20. The shade leg portion 28B is inserted into the rectangular opening portion and clamped between both upright wall portions 20*g*.

The vehicle headlamp 10 according to the invention is equipped with the shade driving unit 24 for pivoting the reflector 22 between two positions. The reflector 22 is capable of shading part of light incident on the reflective surface 20*a* of the reflector 20 from the discharge light emitting portion 18*a* of the discharge bulb 18. The shade driving unit 24 is provided below the discharge bulb 18 with the fixed shade 28 for covering the reflector 22, which is provided close to the front side of the movable shade 22. Thus, the shade moving mechanism of the shade driving unit 24 (e.g., the movable iron core 36 of the solenoid 34, the return spring 38, the shaft member 42, the pin 44, the displacement regulating member 32 and so forth) is substantially concealed from the outside of the lamp.

The shade leg portion 28B of the fixed shade 28 is fitted from the back side of the fixed shade-leg fitting projection 20*f* formed below the reflector 20. Thus, the screw and the like forming the fitting structure are substantially concealed from the outside of the lamp. Consequently, the external appearance of the lamp is improved.

Figure 5:
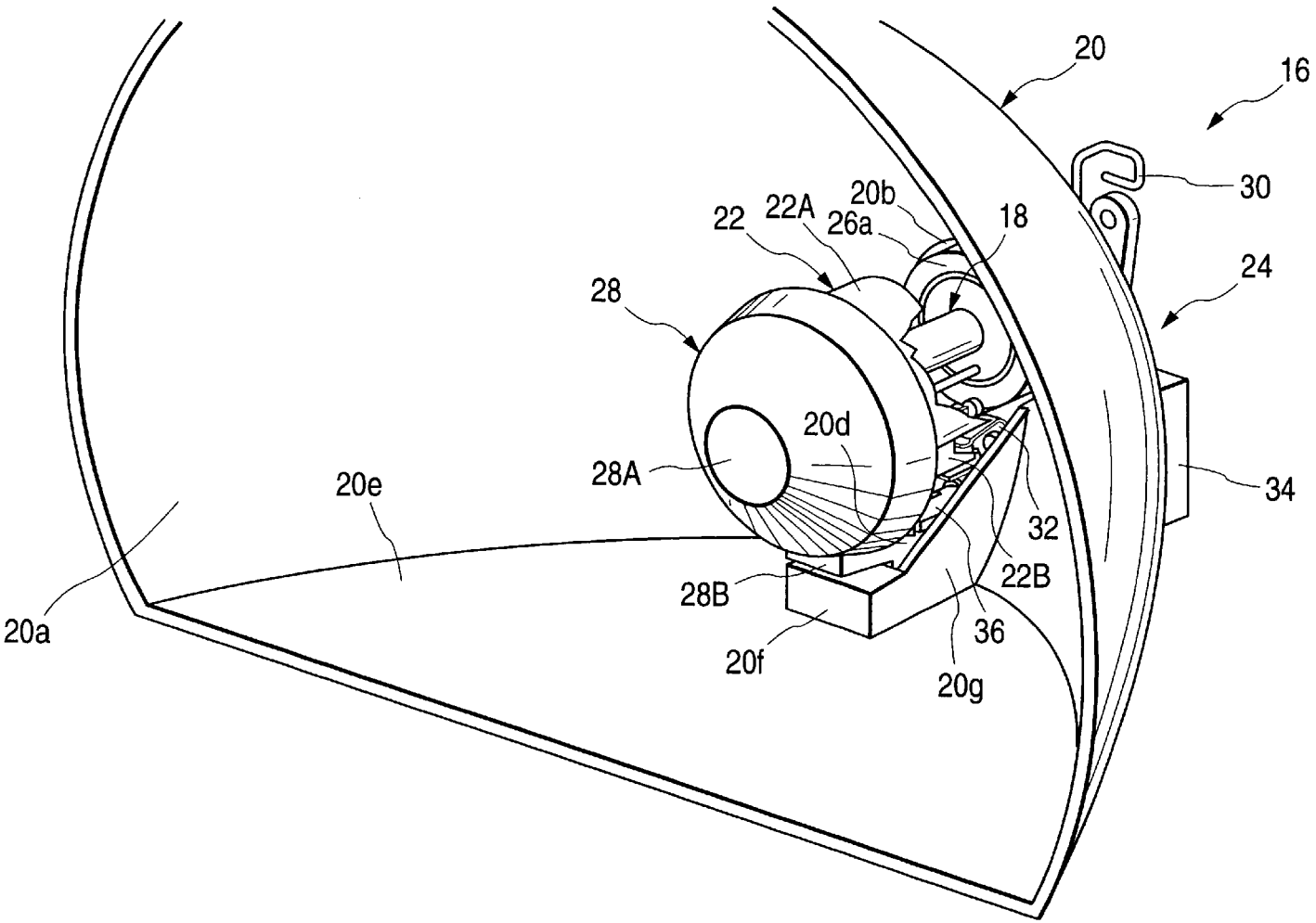
FIG. 5 is an oblique perspective view of portion II of FIG. 1.

The pair of the lateral upright wall portions 20*g* extends backward from the fixed shade-leg fitting projection 20*f* and is formed below the movable shade 22. Further, the shade moving mechanism can be substantially concealed even from a laterally shifted viewpoint as shown in FIG. 5.

Both of the upright wall portions 20*g* are integrally formed with the fixed shade-leg fitting projection 20*f* according to this embodiment of the invention. The fixed shade 28 as well as that of the reflector 20 can be supported sufficiently notwithstanding that the rectangular opening portion 20*d* for receiving the shade moving mechanism is formed at the lower portion of the reflector 20.

The upper end edge of each of the upright wall portion becomes gradually higher from front to back. The support for the fixed shade 28 and the reflector 20 can thus be increased. A mold for easily molding the reflector 20 can also be adopted. Even if the reflector 22 is pivotally moved by the shade driving unit 24 as in this embodiment of the invention, the interference by the reflector is avoided. Thus, the shade moving mechanism can be substantially concealed from both sides of the fixed shade 28.

Figure 6:
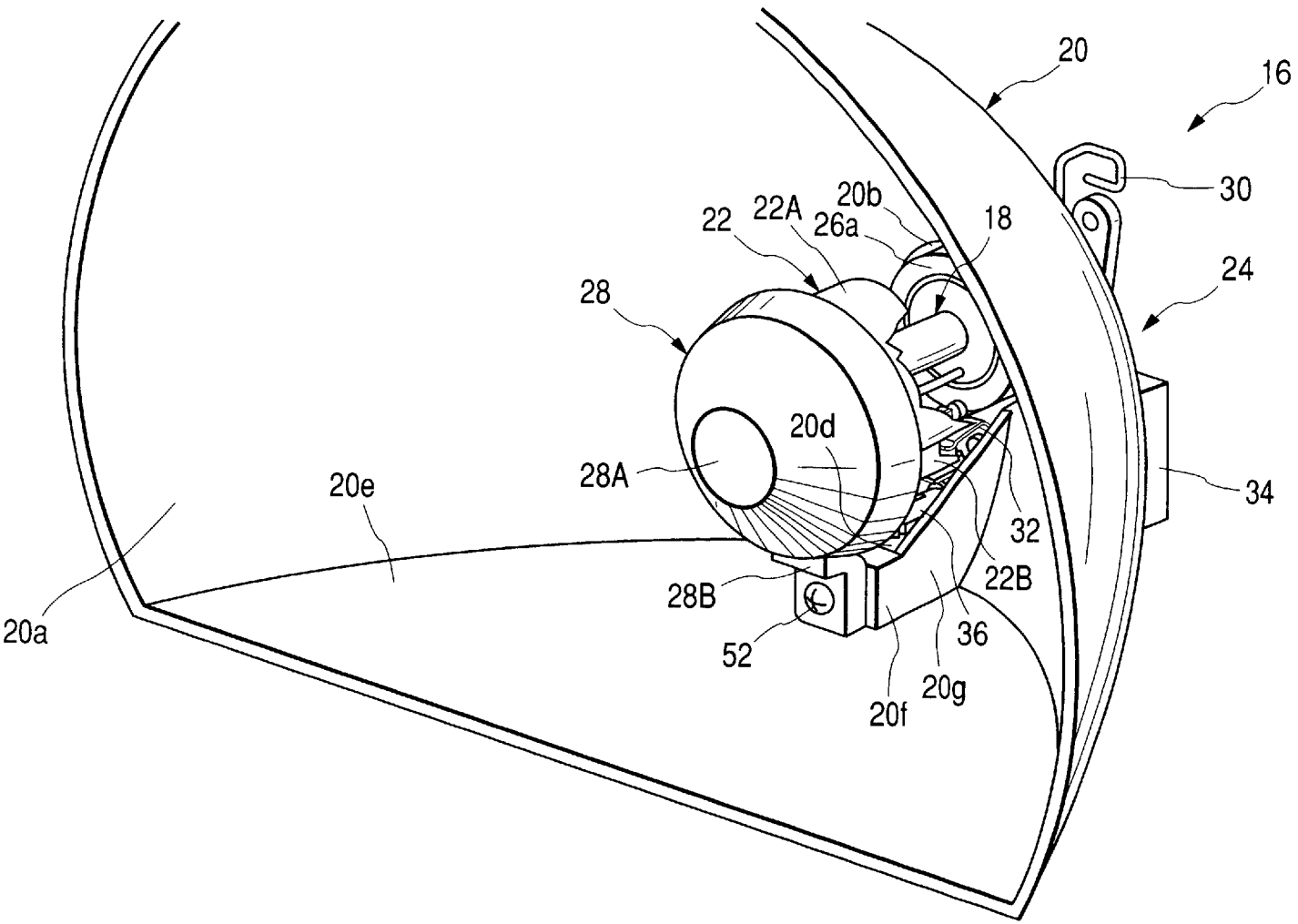
FIG. 6 is a perspective view of another embodiment of the invention.

Instead of fitting the shade leg portion 28D from the rear side of the fixed shade-leg fitting projection 20*f*, the shade leg portion 28B may be fitted from the front side of the fixed shade-leg fitting projection 20*f* as shown in FIG. 6.

Also in this instance, since the pair of lateral upright wall portions 20*g* extends backward from the fixed shade-leg fitting projection 20*f* and is formed below the movable shade 22, the shade moving mechanism can be substantially concealed from either side of the fixed shade 28, even from a laterally shifted viewpoint from the front of the lamp.

The present invention claims priority from Japanese patent application serial no. H2000-023051, which is incorporated herein by this reference in its entirety.

Other implementations are within the scope of the following claims.

What is claimed is:

1. A vehicular headlamp comprising:

a light source;

a reflector, disposed behind the light source, for forwardly reflecting light from the light source;

a reflector, disposed in front of the light source, blocking part of light incident on the reflector from the light source;

a shade driving unit, configured below the light source, for moving the reflector to at least two positions;

a fixed shade, disposed in front of the reflector, for covering the reflector;

a pair of lateral upright wall portions, formed beside the shade driving unit, substantially concealing the shade driving unit;

a projection, connected to the upright wall portions, anchoring the fixed shade at below the light source.

2. The vehicular headlamp as claimed in claim 1, wherein the fixed shade is attached to the projection, which is disposed substantially in front of the shade driving unit, from a backside of the projection towards the shade driving unit.

3. The vehicle headlamp as claimed in claim 1 further comprising:

a fixed shade leg attached to the fixed shade; the fixed shade leg being attached to the projection, which is disposed substantially in front of the shade driving unit, from backside of the projection facing towards the shade driving unit.

4. The vehicular headlamp as claimed in claim 1, wherein each upright wall portion gradually increases in height from front to back of the upright wall portion towards the reflector.

5. The vehicle headlamp as claimed in claim 1, wherein the one position is for high beam and the other position is for low beam.

6. The vehicle headlamp as claimed in claim 1, wherein the reflector is pivotally coupled to the shade driving unit.

7. The vehicle headlamp as claimed in claim 1, further comprising:

a reflector leg attached to the reflector, the reflector leg being pivotally coupled with the shade driving unit.

8. The vehicle headlamp as claimed in claim 7, wherein the reflector leg has a slit where the shade driving unit is coupled to allow for the reflector to pivot when the shade driving unit moves linearly.

9. The vehicle headlamp as claimed in claim 1, wherein the projection and the pair of the lateral upright wall portions are integrally formed.

* * * * *